United States Patent [19]

Mathou

[11] Patent Number: 4,530,123

[45] Date of Patent: Jul. 23, 1985

[54] REST BED, MORE SPECIALLY FOR YOUNG CHILDREN

[76] Inventor: Marcel Mathou, 12630 - Gages, France

[21] Appl. No.: 374,023

[22] Filed: May 3, 1982

[30] Foreign Application Priority Data

May 6, 1981 [FR] France ..... 81 09040

[51] Int. Cl.[3] ..... A47C 19/16

[52] U.S. Cl. ..... 5/110; 5/82 R; 5/411

[58] Field of Search ..... 5/110, 200 R, 186 B, 5/411, 279 B, 82 R, 286, 111, 112, 193, 402, 410; 297/452, 455

[56] References Cited

U.S. PATENT DOCUMENTS

| | | | |
|---|---|---|---|
| 620,591 | 3/1899 | Jackson | 5/200 R |
| 1,228,604 | 6/1917 | Sandell | 5/411 |
| 1,259,650 | 3/1918 | McIntyre | 5/411 |
| 1,344,450 | 6/1920 | McAllaster | 5/411 |
| 1,820,283 | 8/1931 | Mills | 5/110 |
| 1,842,873 | 1/1932 | Leeking | 5/411 |
| 2,361,289 | 10/1944 | Nicholas | 5/82 |
| 2,384,299 | 9/1945 | Gunnell | 5/82 |
| 2,682,670 | 7/1954 | Crump | 5/82 |

FOREIGN PATENT DOCUMENTS

| | | | |
|---|---|---|---|
| 520092 | 6/1953 | Belgium | 5/110 |

*Primary Examiner*—Gary L. Smith
*Assistant Examiner*—Michael F. Trettel
*Attorney, Agent, or Firm*—Cushman, Darby & Cushman

[57] ABSTRACT

The bed of the disclosure includes a foam overlay mattress (1) and a mattress support (2) in the shape of a ladder, releasably connected together by at least a strap (6) the ends of which are brought down around rods (3) of the mattress structure in order to be hooked, under the overlay mattress, to lugs (5) upwardly protruding from the mattress structure, such straps being provided with hooking rings (8) for that purpose. The mattress structure is completed by pairs of short feet (9).

4 Claims, 3 Drawing Figures

REST BED, MORE SPECIALLY FOR YOUNG CHILDREN

FIELD OF THE INVENTION

The present invention relates to a rest bed and more particularly a bed for use by young children when taking a nap in day nurseries or nursery schools.

DESCRIPTION OF THE PRIOR ART

As compared to conventional beds in a bedroom, rest beds should be frequently handled in order to be laid out during nap periods, and then put away in order to clear the room. Such numerous handlings require that rest beds have a light and sturdy structure. On the other hand, owing to such handlings and the use thereof by young children, the overlay mattress should be prevented from sliding off of the mattress support and the bed should further offer perfect safety, by avoiding, among others, sharp edges. Conventional beds used to that end are of the folding type or camp beds and are therefore uncomfortable, difficult to handle and show servious hazards of having people's fingers jammed.

BRIEF SUMMARY OF THE INVENTION

The present invention provides a rest bed having a particularly simple and light structure allowing to lockably but releasably connect the overlay mattress to the mattress support, thereby to handle and easily put away, particularly to stack, the so associated bed.

The present invention further provides a safety rest bed, with an almost retractable mattress under the overlay mattress, the complete bed showing no protruding hard part and being capable of being covered with a current mattress protecting bag.

To this end, according to a feature of the present invention, a rest bed, including an overlay mattress and a mattress support, includes movable means to lockably connect said overlay mattress to said mattress support and prevent said overlay mattress from relatively moving in relation to said mattress support.

According to a particular feature of the invention, said connecting means include at least a first pair of lugs protruding from the upper bearing surface of the mattress support, at least two openings in the mattress support, at least two openings in the mattress support adjacent to said first pair of lugs, respectively, and a strap which can be applied around the overlay mattress, passed through said openings and hooked by the ends thereof to the respective lugs under said overlay mattress.

According to a further particular feature of the invention, the mattress support has the configuration of a ladder and includes two pairs of short feet.

The strap and lug assembly ensures a perfect connection between the overlay mattress and the mattress support, preventing said overlay mattress from moving or from sliding in relation to the mattress support, returning the fasteners of the strap ends onto the lugs run into the soft material of the overlay mattress lower face making a locked or auto-blocked fixing, thereby preventing young children from untying said strap. Said strap does not require being resilient and can be a conventional woven textile strap.

BRIEF DESCRIPTION OF THE DRAWINGS

One way of carrying out the invention is described in detail below with references to the drawings which illustrate only one specific embodiment, in which.

DETAILED DESCRIPTION OF THE DRAWINGS

Figure 1:
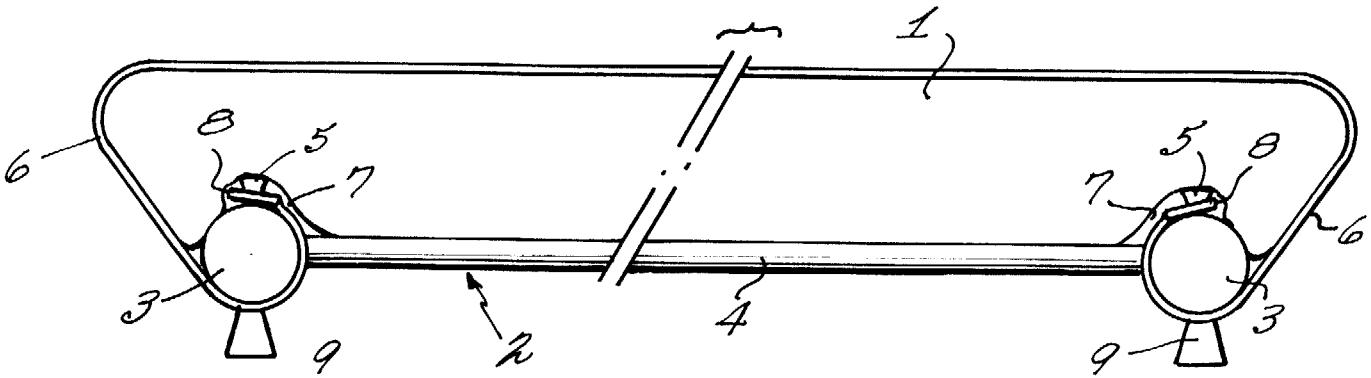
FIG. 1 is a conventional diagram showing the bed strap arrangement according to the invention.
Figure 2:
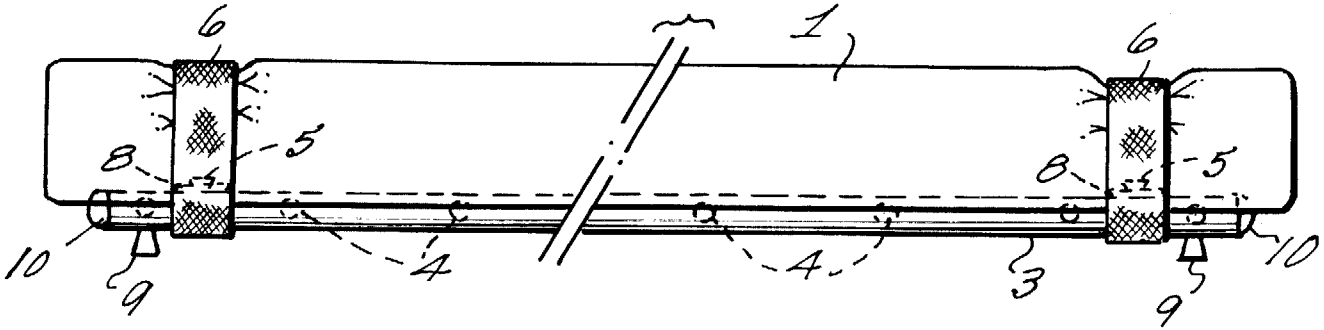
FIG. 2 is a side diagram of the bed according to the invention.
Figure 3:
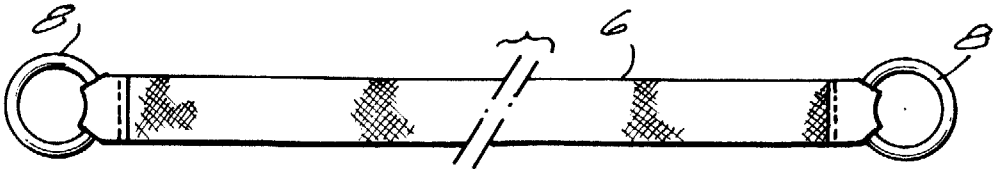
FIG. 3 is a view of a strap for use with the bed of FIGS. 1 and 2.

As shown in FIGS. 1 and 2, the rest bed, for use more specially by young children, according to the invention, includes an overlay mattress 1, typically a conventional foam overlay mattress, and a mattress support 2, having advantageously the configuration of a ladder with two parallel longitudinal rods 3 connected by small bars 4, which function as the mattress slats. Next to the opposed ends of rods 3 are provided two pairs of lugs 5, upwardly protruding from the upper edge of rods 3. A strap 6 is transversally placed all around overlay mattress 1, the ends thereof being wrapped around rods 3 within the space between two small bars, as shown in FIG. 1, in order to be connected to lugs 5. The strap not being in use, overlay mattress 1 normally rests on the upper edges of rods 3, with lugs 5 only running very slightly into the flexible material of overlay mattress. By applying and stretching said strap in the above mentioned manner, overlay mattress 1 is more strongly held on the mattress support in order to bear against small bars 4, with a more pronounced hollow 7 being formed at right angles with lugs 5, a manual voluntary bending of overlay mattress foam then being required to get access to said lugs, which can only be simply made by grown-ups. According to the invention, strap 6 is provided at its ends with two hooking rings 8 to be threaded in lugs 5, the strap fastening on lugs 5 becoming thus totally invisible and ignored for a young child as it is embedded inside the overlay mattress material. Such an arrangement allows therefore to connect overlay mattress 1 to mattress support 2 without substantially flattening out or distorting the overlay mattress and without any risk that strap 6 be unhooked, which would be dangerous should flexible straps be used. According to the invention, strap 6 can be made of non flexible material and includes woven tissue such as for safety belts, the overall length thereof being determined by the dimensions of the overlay mattress and mattress elements.

The mattress support 2 is completed by two pairs of short feet 9, about 20 mm high, at the ends of rods 3 and longitudinally offset with respect to the pairs of adjacent lugs 5 in order to allow straps 6 to be wrapped around the lower and internal face of rods 3. This very low ground clearance of the mattress structure, on one hand allows limiting the overall height of the rest bed, so ensuring the stability thereof and limiting risks of any child lying on the bed from falling out and, on the other hand, has the advantage that, should a heavy grown-up sit on the bed, rods 3 and small bars 4 will bend in a limited way and bear against the ground, so preventing said elements from being damaged, possibly broken, the mattress assembly therefore showing the safety, flexibility and resiliency suitable for young chuldren.

As it appears in FIG. 2, the mattress structure is so dimensioned as the overall periphery is well within the normal periphery of overlay mattress 1, so that the assembled rest bed is essentially reduced, visually, to the overlay mattress, no solid part protruding from the overlay mattress useful regions. For safety purposes, rod 3 ends are further provided with caps 10, for instance in the form of an elastomer. The rest bed configuration according to the invention fully clears the overlay mattress useful surface, said mattress having the periphery thereof protruding from the frame in relation to the mattress support, so that a conventional overlay mattress cover can be placed on the overlay mattress strapped on the mattress support, the practical aspect thereof being obvious for any concerned educator.

Owing to the overlay mattress being strapped on the mattress support, the rest bed assembly can be handled by simply gripping said overlay mattress, such beds being easily piled or coupled to one another due to the low height of feet 9. Said feet can be in the shape of a cylinder or a truncated cone as shown in FIG. 2, lugs 5 being advantageously in the shape of inverted truncated cones, as shown in FIG. 1, in order to ensure a further hooking of rings 8. In a preferred embodiment of the invention, the mattress support is obtained by using wood, lugs 5 having a maximum diameter of 20 mm and a protruding height of 25 mm. According to specific requirements, straps 6 can be sewn, through their middle part, to the overlay mattress or bound to the latter or connected through releasable hooking systems such as microlinks or microhooks having the trademark VELCRO. Such measures, however, preventing the overlay mattress from being reversible, are not required with the bed system according to the invention.

The illustrated embodiment has been discussed only as a means for clarifying one application of the present invention and should not be taken as a limitation or restriction of the scope of the invention. Specially, instead of having a mattress support in the shape of a ladder, one can use, in a more conventional way, a simple apertured board, for example a fiber board, on which are fitted small feet 9 and lugs 5, a large opening being however provided in the board in the in the vicinity of each lug 5 in order to allow strap 6 to be passed through the ring 8 thereof being threaded in the concerned lug 5.

What I claim is:

1. A rest bed comprising a mattress support, a mattress overlaying said mattress support, at least two lugs extending upwardly on opposite sides of said mattress support and at least one strap secured to said mattress support proximate said lugs, said strap being stretched over said mattress and above said lugs whereby said mattress is firmly pressed on said upwardly extending lugs, said mattress support being provided with at least two openings adjacent to said lugs, said strap further extending below said mattress support through said openings and being provided, at both ends thereof, with hooking rings which are engageable around said lugs.

2. A rest bed according to claim 1 wherein said mattress support comprises two parallel rods connected by a plurality of bars extending transversely to said rods said openings being formed by the spaces between said bars and wherein said lugs protrude from the upper side of said rods.

3. A rest bed according to claim 2 comprising two pairs of lugs respectively adjacent to opposed ends of said rods and two straps each cooperating with one pair of lugs.

4. A bed according to claim 1 wherein said lugs are inverted truncated cones.

* * * * *